US010066416B2

(12) United States Patent
Ying

(10) Patent No.: US 10,066,416 B2
(45) Date of Patent: Sep. 4, 2018

(54) COMPACTABLE STORAGE COVER

(71) Applicant: I/O Controls Corporation, Azusa, CA (US)

(72) Inventor: Jeffrey Ying, Glendora, CA (US)

(73) Assignee: I/O Controls Corporation, Azusa, CA (US)

( * ) Notice: Subject to any disclaimer, the term of this patent is extended or adjusted under 35 U.S.C. 154(b) by 0 days.

(21) Appl. No.: 14/636,849

(22) Filed: Mar. 3, 2015

(65) Prior Publication Data

US 2015/0240514 A1 Aug. 27, 2015

Related U.S. Application Data

(62) Division of application No. 12/850,554, filed on Aug. 4, 2010, now Pat. No. 8,967,172.

(51) Int. Cl.

| | |
|---|---|
| ***E04H 15/38*** | (2006.01) |
| ***E04H 15/40*** | (2006.01) |
| ***E04H 6/04*** | (2006.01) |
| *B63B 17/02* | (2006.01) |
| *B63B 19/19* | (2006.01) |

(52) U.S. Cl.

CPC ..... *E04H 15/38* (2013.01); *E04H 6/04* (2013.01); *E04H 15/40* (2013.01); *B63B 17/023* (2013.01); *B63B 19/19* (2013.01)

(58) Field of Classification Search

CPC ..... E04H 6/04; E04H 15/38; E04H 15/40
USPC ..... 135/88.05, 129, 137
See application file for complete search history.

(56) References Cited

U.S. PATENT DOCUMENTS

| | | | | | |
|---|---|---|---|---|---|
| 2,817,344 | A | * | 12/1957 | Teeter | E04H 6/04 135/117 |
| 2,858,837 | A | * | 11/1958 | Harper | B60J 11/00 135/129 |
| 3,030,973 | A | | 4/1962 | Janda et al. | |
| 3,415,260 | A | | 12/1968 | Hall | |
| 3,469,587 | A | * | 9/1969 | Folkes | E04H 3/165 135/119 |
| 3,729,890 | A | * | 5/1973 | Yamamoto | B66C 7/00 104/246 |
| 3,845,591 | A | | 11/1974 | Stine | |
| 4,480,675 | A | | 11/1984 | Berkemeier | |
| 4,821,785 | A | | 4/1989 | Rolan | |
| 4,844,109 | A | * | 7/1989 | Navarro | E04H 15/505 135/129 |

(Continued)

*Primary Examiner* — Noah Chandler Hawk
(74) *Attorney, Agent, or Firm* — Irell & Manella, LLP

(57) ABSTRACT

A cover mechanism comprises a support frame with base supports and a multi-part expandable cover engaged with the base supports by grappling members or other means. The expandable cover may have a pliable exterior cover and a set of integral ribs, the expandable cover being foldable when not deployed and being expandable to form a self-supporting structure when deployed. The base supports may provide a sliding track for the grappling members to facilitate expansion of the cover. The base supports may be adapted to rest on the ground or buoyant so that the cover can be used with watercraft. The expandable cover may be deployed by pivoting it from a folded position to an upright position, sliding the cover along the base support tracks, and pivoting the cover from the front of the base supports downwards, forming an enclosure thereby.

11 Claims, 8 Drawing Sheets

(56) References Cited

U.S. PATENT DOCUMENTS 4,886,083 A * 12/1989 Gamache ..... E04H 6/005 135/133
4,944,321 A 7/1990 Moyet-Ortiz
4,951,993 A 8/1990 Taboada
5,005,896 A * 4/1991 Li ..... B60J 7/062 135/129
5,015,029 A 5/1991 Kramer
5,029,933 A 7/1991 Gillem
5,040,557 A 8/1991 Morgan
5,080,426 A 1/1992 Johnson
5,116,273 A 5/1992 Chan
5,121,765 A 6/1992 MacMorris, Jr.
5,159,947 A * 11/1992 Chuang ..... E04H 15/38 135/132
5,161,849 A 11/1992 Holland, Jr.
5,176,421 A 1/1993 Fasiska
5,238,288 A * 8/1993 Chandler ..... B60J 7/104 135/129
5,275,460 A 1/1994 Kraus
5,335,960 A * 8/1994 Benignu, Jr. ..... B60P 3/341 135/88.05
5,472,257 A 12/1995 Kaya
5,546,972 A * 8/1996 Wardell ..... B60J 7/062 135/119
5,597,196 A 1/1997 Gibbs
5,628,542 A 5/1997 Hindson
5,700,048 A 12/1997 Wade et al.
5,740,826 A * 4/1998 Nevin ..... E04H 15/38 135/133
5,820,196 A 10/1998 Rudys et al.
5,823,607 A 10/1998 Hindson
5,845,958 A 12/1998 Rudys et al.
5,927,793 A 7/1999 McGrath, Jr.
6,070,629 A 6/2000 Whiteside
6,109,283 A * 8/2000 Burke ..... E04H 3/165 135/129
6,276,381 B1 8/2001 O'Brien
6,334,456 B1 * 1/2002 Nevak ..... E04H 15/40 108/147.12
6,513,858 B1 2/2003 Li et al.
6,964,447 B2 11/2005 McNamee
6,981,509 B2 1/2006 Sharapov
7,008,002 B2 3/2006 Rhea et al.
7,096,628 B2 8/2006 Millward
7,353,769 B2 4/2008 Unrast et al.
7,455,026 B2 11/2008 Towley et al.
7,481,175 B2 1/2009 Dickman
7,546,844 B2 6/2009 Al-Mutairi
7,740,100 B2 6/2010 Takahashi et al.
7,757,734 B2 7/2010 Hooker et al.
2006/0232095 A1 10/2006 Sedighzadeh
2008/0210284 A1 * 9/2008 Dubois ..... E04H 15/52 135/129
2012/0048320 A1 3/2012 Hardie

* cited by examiner

COMPACTABLE STORAGE COVER

RELATED APPLICATION INFORMATION

This application is a divisional of U.S. patent application Ser. No. 12/850,554, filed Aug. 4, 2010 hereby incorporated by reference as if set forth fully herein.

BACKGROUND OF THE INVENTION

1) Field of the Invention

The field of the present invention generally relates to storage covers and, more particularly, to storage covers for vehicles or conveyances including automobiles, motorcycles, watercraft, and the like.

2) Background

When not in use, vehicles or other conveyances (such as watercraft) generally need to be stored in a manner that protects them from the elements and preserves their longevity. Failure to do so may cause parts to corrode, paint to fade or peel, mechanical or electrical parts to fail, and other deleterious effects. In addition, when a vehicle or conveyance is exposed to the elements, dirt and sediment can accumulate, which can have a number of undesirable effects.

Land vehicles such as cars, motorcycles and trucks are often stored in a garage when not in use, in order to keep the vehicle secure and protected from the elements. However, a garage is not always available for storage. In such a case, a fabric cover or tarp may be used to provide some protection to the vehicle, but these are not always effective. For example, a fabric cover or tarp may not cover the entire vehicle. It may also allow rainwater or other moisture to seep beneath or through it. A fabric cover or tarp may also be inconvenient to deploy, or take an inordinate amount of time. Often a fabric cover needs to be secured with a rope, cable or other flexible member, which can take extra time to wrap beneath the vehicle and requires several steps to secure. A fabric cover or tarp can be cut with a sharp implement, and is potentially subject to theft, particularly if not properly secured. Moreover, such a cover generally closely follows the contours of the vehicle, providing no structural protection to the vehicle.

Analogous problems exist with boat covers. Fabric covers or tarps suffer from many of the same problems as with those used for land vehicles. A number of proposals have been made to provide more convenience or better protection; for example, one proposal involves using a solid structure with a roof, from which a fabric cover can be lowered. Such proposed structures can be expensive, complex, and lacking in flexibility.

It would therefore be advantageous to provide a mechanism for covering a vehicle or conveyance, such as an automobile, motorcycle, truck or watercraft. It would further be advantageous to provide a cover mechanism for a vehicle or conveyance which is convenient to use, is effective against the elements or other types of harm, and can be deployed or retracted quickly. It would also be advantageous to provide such a cover mechanism which is inexpensive and not overly complex.

SUMMARY OF THE INVENTION

The invention is generally directed in one aspect to a novel and versatile cover mechanism that is particularly well suited for a vehicle or conveyance, but which may find other uses or applications as well. According to one embodiment as disclosed herein, a cover mechanism comprises a support frame adapted to rest on stable surface (e.g., the ground), and an expandable cover engaged with the support frame, with the expandable cover being foldable when not deployed and being expandable to form a self-supporting structure when deployed.

In various forms and embodiments, the cover mechanism may include a support frame comprising a pair of parallel base supports, optionally with one or more crossbeams connecting them. The expandable cover may include a pliable exterior cover and a plurality of ribs integral therewith.

In some embodiments, the expandable cover may be attached to the support frame via a plurality of grappling members, such as hooks and/or wheels or other means. Where the support frame includes a pair of a parallel base supports, each may have a lengthwise groove for guiding the expandable cover whereby the grappling members slide along the length of the grooves to guide the deployment of the expandable cover. In certain embodiments, the expandable cover is deployed from a flattened compact storage position by pivoting a front end of the expandable cover from an approximately horizontal orientation until it reaches an approximately vertical orientation, sliding the front end of the expandable cover forwardly along the parallel base supports, and pivoting the front end of the expandable cover downwards until it lies in proximity with the firm surface, thereby causing the ribs to spread apart and the pliable exterior cover to expand therebetween.

The expandable cover may be made of a durable, moisture resistant material, such as for example vinyl, nylon, plastic, or treated canvas. The cover mechanism may be used as a storage cover for vehicles or other conveyances, and may be adapted, by use of a buoyant support frame, to store watercraft for example.

Further embodiments, variations and enhancements are also disclosed herein.

DETAILED DESCRIPTION OF PREFERRED EMBODIMENT(S)

According to various embodiments as disclosed herein, a cover mechanism may be constructed as a multi-part folding storage unit that includes, in at least some embodiments, a support frame adapted to rest on stable surface (e.g., the ground), and an expandable cover engaged with the support frame, with the expandable cover being foldable when not deployed and being expandable to form a self-supporting structure when deployed. The support frame may include a pair of base supports with sliding tracks for guiding the deployment of the expandable cover. The expandable cover may be formed of a pliable exterior cover (such as vinyl, plastic, etc.), that is reinforced with ribs providing its structural shape when deployed. Preferably, the expandable cover is raised from a flattened, folded position to an upright position by pivoting the cover relative to the base supports; then the cover is slid or guided forward along the base supports; and finally the cover is pivoted downwards to the ground or other surface, completing a self-supporting enclosure. Variations of the above, as well as other useful features, may also be incorporated in the novel cover mechanism disclosed herein.

Figure 1A:
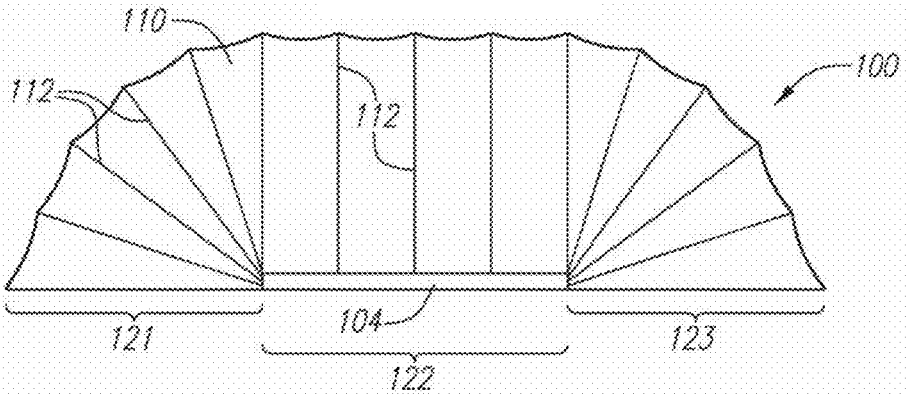
FIG. 1A is a side view diagram showing an example of a cover mechanism in a fully deployed state, in accordance with one embodiment as disclosed herein.
Figure 1B:
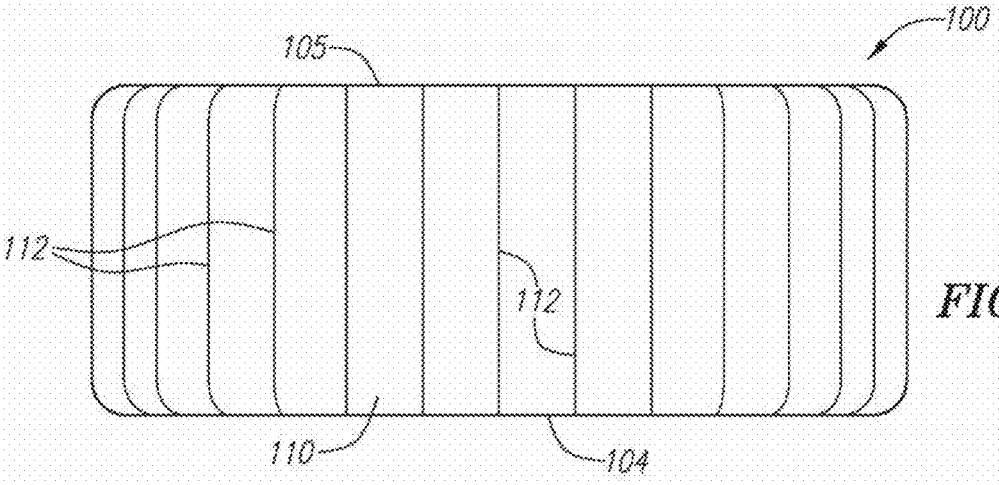
FIGS. 1B and 1C are oblique and top view diagrams, respectively, of the cover mechanism illustrated in FIG. 1A.
Figure 1C:
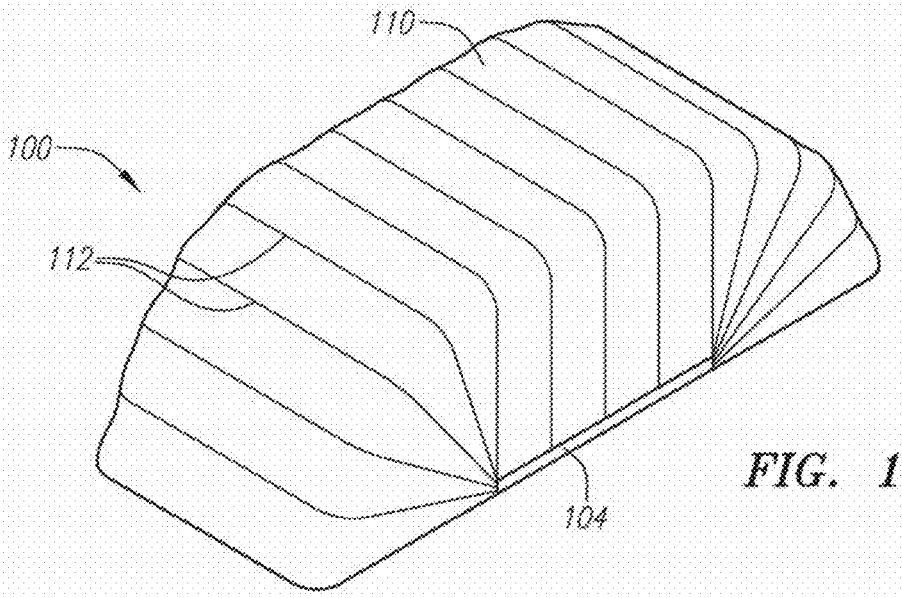
Figure 2A:
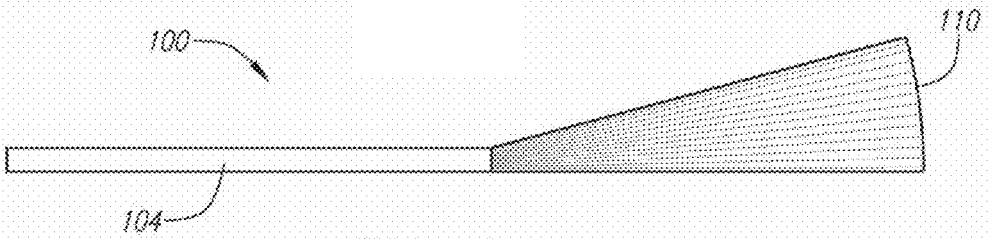
FIGS. 2A-2C are diagrams from different viewpoints of the cover mechanism illustrated in FIG. 1A-1C, showing the cover mechanism in a compact or non-deployed state.
Figure 2B:
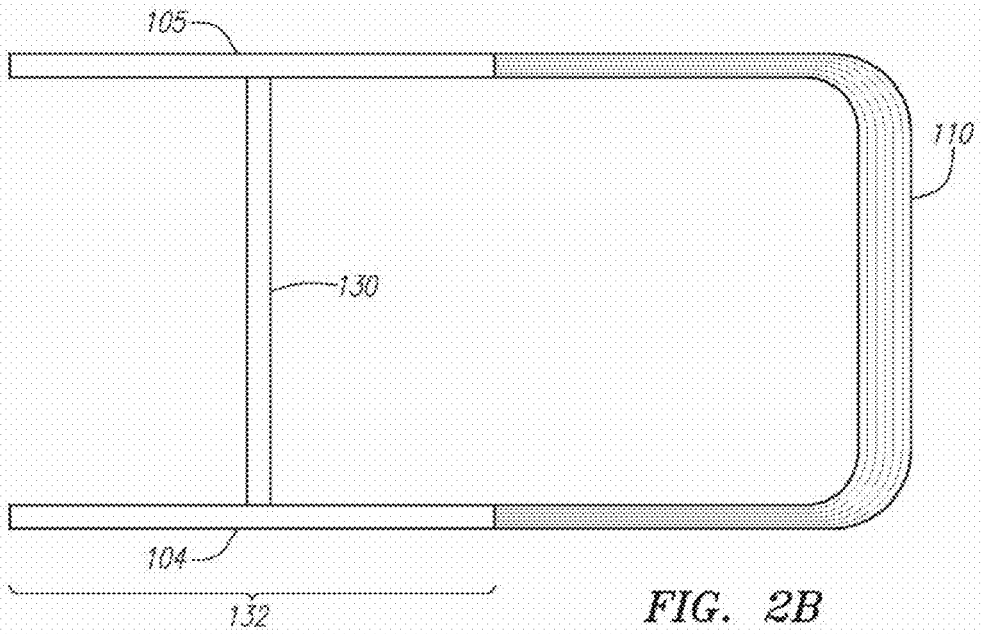
Figure 2C:
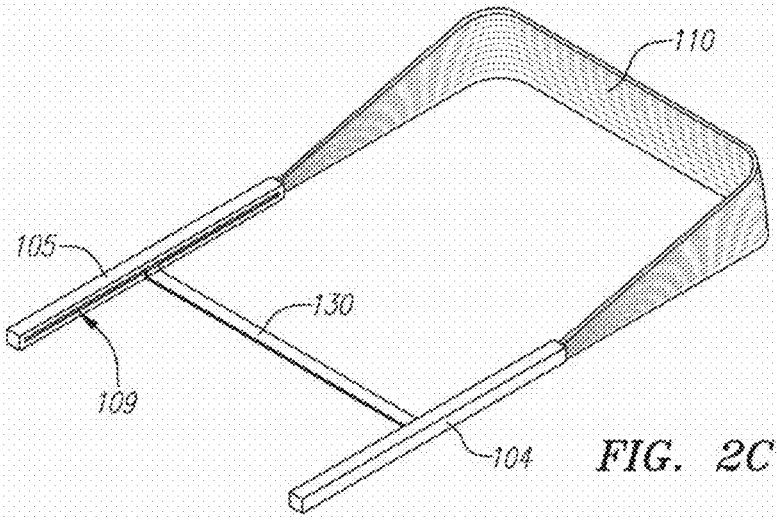

FIG. 1A is a side view diagram of an example of a cover mechanism 100 in a fully deployed state, in accordance with one embodiment as disclosed herein. FIGS. 1B and 1C show the cover mechanism 100 from an oblique view and top view, respectively. FIGS. 2A-2C show the cover mechanism 100 from different viewpoints, in a compact or non-deployed state. As explained further herein, the cover mechanism 100 may be particularly well suited for vehicles or other conveyances, including watercraft.

As illustrated in FIGS. 1A-1C and 2A-2C, the cover mechanism 100 may include a pair of extension tracks 104, 105 to which are attached a folding and slidable expandable cover 110. In a preferred embodiment, the cover mechanism 100 is preferably constructed so that the expandable cover 110 has a front unit 121, a middle unit 122, and a rear unit 123, although the expandable cover may be constructed with fewer or more units depending upon the desired size and complexity of the mechanism. The expandable cover 110 is preferably formed of a fabric-like material reinforced with a set of ribs 112. The expandable cover 110 may, for example, be formed of a pliant, water-resistant material such as vinyl, plastic, or treated canvas, although it may be made from other materials as well, including composite or multi-layer materials. The ribs 112 are preferably lightweight and flexible in design, and may be formed, for example, of molded plastic, coated aluminum, or other lightweight and sturdy materials, preferably treated, if necessary, to resist moisture. The ribs 112 may be, for example, sewn into a special pocket or series of fabric loops on the interior of the expandable cover 110, or otherwise securably attached to the expandable cover 110.

As illustrated in FIGS. 1A-1C, which shows the cover mechanism 100 as unfolded or unfurled, the cover mechanism 100 may be generally elongate in nature, roughly tube-shaped but curved downward at each end so as to preferably entirely enclose an item, such as a vehicle or conveyance, therebeneath to protect it from the elements or otherwise. The cover mechanism 100 may include a middle unit 122 that is generally tube-shaped, although in cross section it may be any suitable shape, including as depicted roughly square or trapezoidal in cross section with rounded corners. The base of the expandable cover 110 in the middle unit 122 may be secured to base supports 104, 105 which may comprise, for example, rails along which the expandable cover 110 may be slid or guided to fold or unfold the expandable cover 110. Preferred means for attaching the expandable cover 110 to the base supports 104, 105 are described later herein. The cover mechanism 100 may further include a rear unit 123 and front unit 121, which may be generally symmetrical in shape, and which may share the same general cross-sectional shape with the middle unit 122 but may be curved so that the top of the expandable cover 110 at the edge of the middle unit 122 arcs downward until it meets the ground or other resting surface of the cover mechanism 100.

In some embodiments, the ribs 112 may be embodied as pre-formed rods having a shape corresponding to the cross-section of the expandable cover 110 when fully deployed. The ribs 112 may provide the framing which determine the shape of the self-supporting structure created by deployment of the cover mechanism 100, with the expandable cover 110 providing the "walls" or "skin" of the structure and being supported by the ribs 112.

In a preferred embodiment, the expandable cover 110 is securely pinned or attached to one end of the base supports 104, 105 proximate the rear unit 123, allowing the expandable cover 110 to pivot at that end of the base supports 104, 105, so that the expandable cover 110 gradually rotates upwards, unfolding from a flattened or folded position to form a quarter-circle or toroidal shape as the expandable cover 110 reaches full height. The expandable cover may then be slid or guided along the base supports 104, 105 so that it further unfolds or unfurls the middle portion of the expandable cover 110, whereupon it reaches the other end of the base supports 104, 105 proximate the front unit 121. At that point, the expandable cover 110 is further unfolded or unfurled by pivoting at that end of the base supports 104, 105 to gradually rotate downwards, so that it eventually forms another quarter-circle or toroidal shape as the end of the expandable cover 110 is brought down to rest on the ground or resting surface over the cover mechanism 100, thereby forming the symmetrically-shaped covering as illustrated in FIGS. 1A-1C. As the expandable cover 110 is unfolded or unfurled, the ribs 112 rotate or slide apart from each other, allowing the fabric or cover material between the ribs 112 to expand and thereby reach the fully deployed size of the covering.

In FIGS. 2A-2C, the cover mechanism 100 is shown when in a compact or non-deployed state. As shown particularly in FIG. 2B, showing a top view of the cover mechanism 100, a base support frame 132 forms the bottom support structure for the middle unit 122 of the cover mechanism 100, and in this example includes outside base supports 104, 105, and a crossbeam 130 (or set of crossbeams) that connects the base supports 104, 105 to one another. The bottom of the base supports 104, 105 lies on the ground or other resting surface. The expandable cover 110 is shown folded, with the legs of the expandable cover 110 attached to one end of the base supports 104, 105. When used to cover and protect a vehicle such as an automobile, it may be noted that the crossbeam 130 will be located beneath the vehicle and between the front and rear axles, so that together with the expandable cover 110 the cover mechanism 100 forms a complete "ring" around the vehicle. This makes the expandable cover 110 generally impossible or at least very difficult to remove from the vehicle by unauthorized persons, without damaging or harming the cover.

As shown in FIG. 2C, the base supports 104, 105 may each include a slot or groove 109 (although the corresponding slot or groove in base support 104 is not shown because of the angle), whereby the expandable cover 110 may be slid or guided when being deployed. The crossbeam 130 may be attached to the base supports 104, 105 beneath the slots or grooves (i.e., 109) so that it does not interfere deployment of the expandable cover 110.

The expandable cover 110 may be configured so that it is deployed manually, although in large sizes it can also be deployed in an automated fashion using motorized rails or other similar mechanics.

Figure 5A:
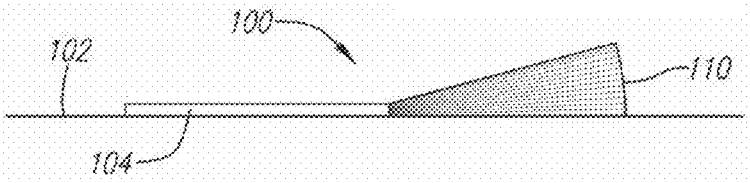
FIGS. 5A-5E are diagrams illustrating operation of the cover mechanism of FIGS. 1A-1C from a compact state to a fully deployed state.
Figure 5B:
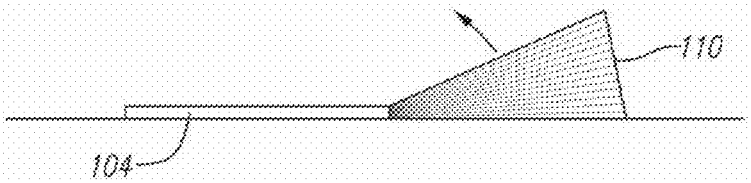
Figure 5C:
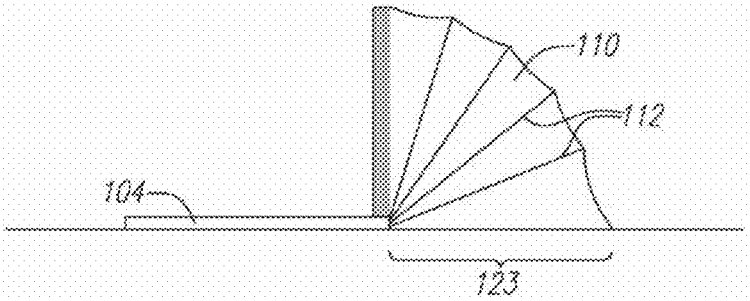

FIGS. 5A-5E are diagrams illustrating use and operation of the cover of FIGS. 1A-1C and 2A-2C from a compact state to a fully deployed state, in side view. As shown first in FIG. 5A, the cover mechanism 100 (similar to FIG. 2A) is in a compact or non-deployed state, with the expandable cover 110 shown folded and resting on the ground or other resting surface 102. In this state, the fabric or cover material of the expandable cover 110 is compressed in folds, with the support ribs 112 (shown in FIG. 5C, e.g.) also being stacked together. The legs of expandable cover 110 are pivotably attached to one end of base supports 104, 105 (only one of which, 104, is illustrated from the side view), as previously shown and described with respect to FIG. 2B. As shown in FIGS. 5B and 5C, the expandable cover 110 is gradually unfolded or unfurled, manually or by use of automated or motorized assistance, causing the ribs 112 to gradually separate and expand the material of the expandable cover 110 therebetween, in an accordion-like fashion. Eventually, the rear unit 123 of the cover mechanism 100 is deployed when the expandable cover 110 has rotated ninety degrees so that the front ribs 112 of the expandable cover 110 are upright, perpendicular to the resting surface 102. In a preferred embodiment, the expandable cover 110 is locked in the pivoting position during the time when the rear unit 123 is being deployed, and is released at the point that the expandable cover 110 has reached the state shown in FIG. 5C, with the front ribs 112 of the expandable cover 110 in an upright position.

Figure 5D:
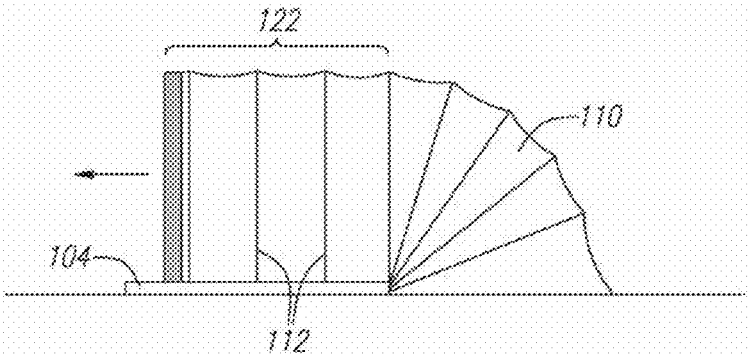
Figure 5E:
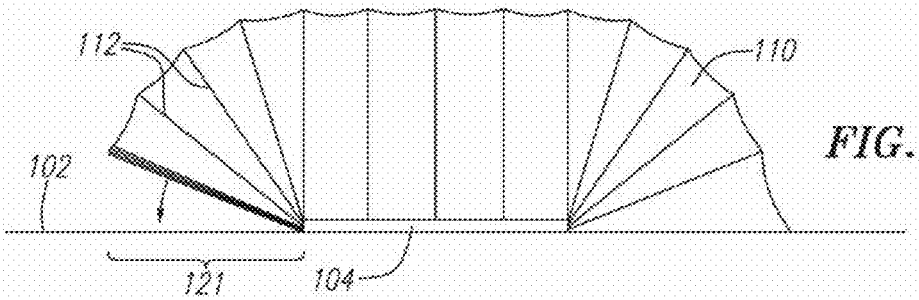

Next, as illustrated in FIG. 5D, the legs of the expandable cover 110 are slid or guided along the base supports 104, 105, allowing the middle unit 122 of the expandable cover 110 to be deployed as the ribs 112 in the middle unit 122 gradually separate. This expansion preferably continues until the middle unit 122 is fully extended by reaching the far end of the base supports 104, 105. Once that occurs, the remaining ribs 112 pivot downwards, gradually unfurling the remaining part of the expandable cover 110 as shown in FIG. 5E until it reaches the resting surface 102. At that point, the front unit 121 is fully deployed, completing the expansion of the cover mechanism 100.

When the cover mechanism 100 has been fully deployed, it may latch or otherwise lock into place, so that unauthorized persons cannot easily remove the cover. Such a latching mechanism may be disengaged, for example, by a key kept by the owner or user of the cover mechanism 100.

Figure 3A:
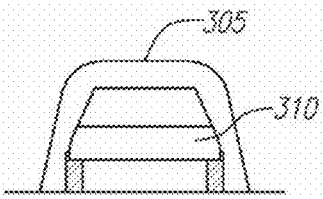
FIGS. 3A-3C are cross-sectional views of covers similar to the mechanism of FIGS. 1A-1C, having different shapes.
Figure 3B:
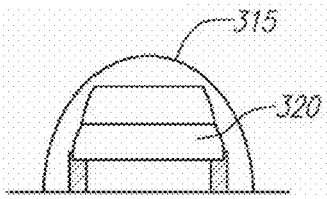
Figure 3C:
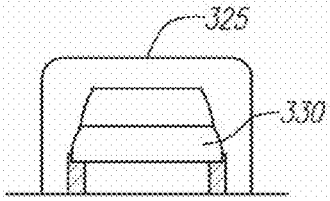

The cover mechanism 100 may have different shapes depending on the particular application and use, or particular preferences. For example, the cover mechanism 100 may have the shape as shown in FIGS. 1A-1C. Other examples are shown in FIGS. 3A-3C, which are cross-sectional views of cover mechanisms having different shapes and sizes. For instance, FIG. 3A shows a cover mechanism 305 surrounding an automobile 310, and having gradually tapered sides. FIG. 3B shows a cover mechanism 315 having a dome-like cross-sectional profile, and thus having rounded or curved sides and top. FIG. 3C shows a cover mechanism 325 having substantially straight, vertical sides, and a relatively flat roof portion. In each case, the ribs of the cover mechanism 305, 315 or 325 may be shaped to provide the desired shape or contours, thereby dictating the shape of the cover when fully deployed.

Figure 6A:
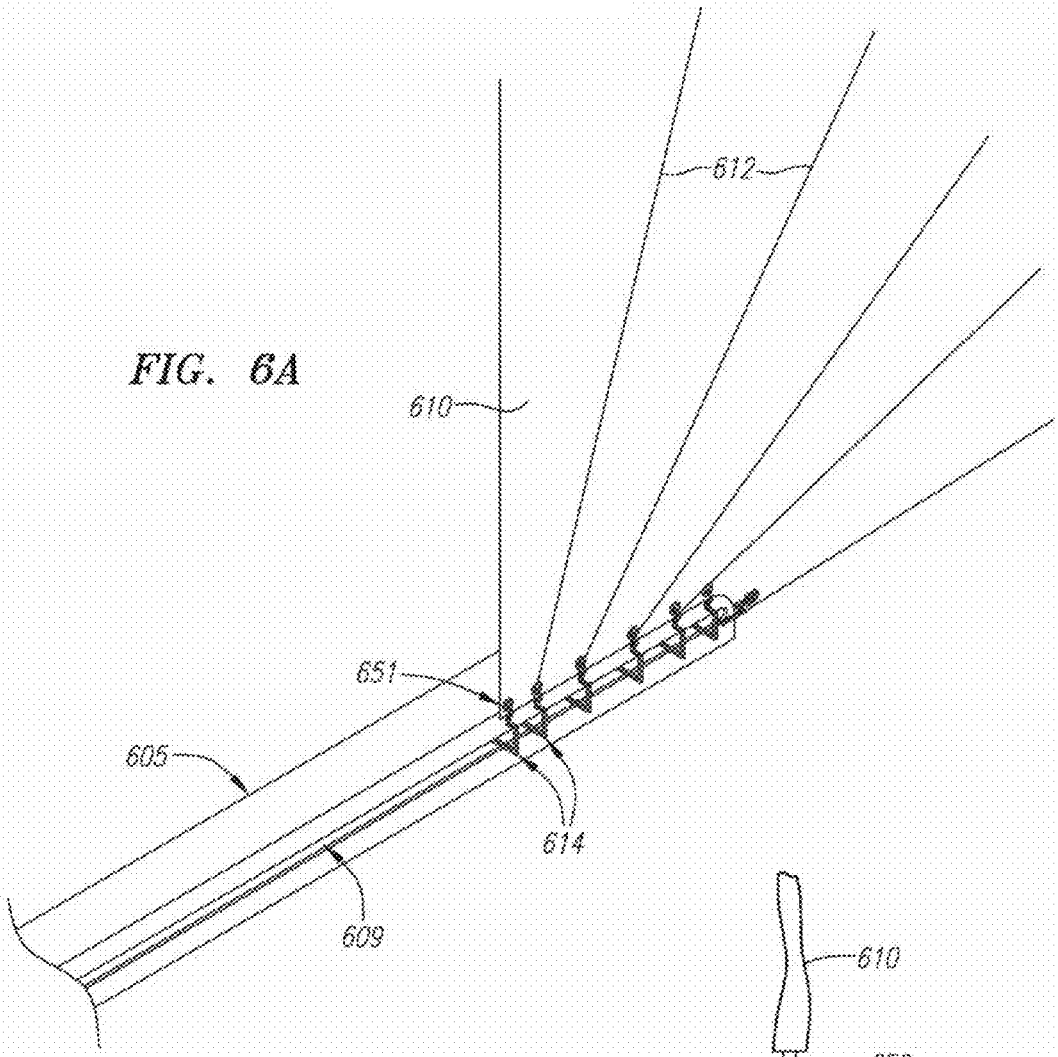
FIG. 6A is a diagram of an embodiment of a sliding extension track that may be used in various embodiments of a vehicle cover as disclosed herein, including the embodiment of FIGS. 1A-1C.
Figure 6B:
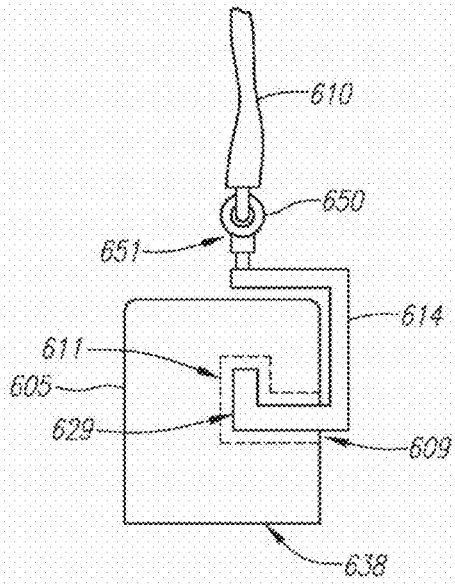
FIG. 6B is a cross-sectional diagram of the sliding extension track shown in FIG. 6A.

A variety of different mechanisms may be used to guide the expandable cover 100 along base supports 104, 105 as shown in FIGS. 5A-5E, and FIG. 5D in particular. For example, the expandable cover 100 may be guided with hooks, wheels, or other grappling members that move along a slot, track or other guide associated with the base supports 104, 105. An example of one such technique is illustrated in FIGS. 6A and 6B, which are diagrams of an embodiment of a sliding extension track that may be used in connection with a base support 605 in various embodiments of a vehicle cover as disclosed herein. As shown in FIG. 6A, and from cross-sectional view in FIG. 6B, the base support 605 may be generally elongate with flat bottom surface 638 for resting on the ground or other similar surface. The base support 605 has an elongate groove or slot 609 which in this example is located on the interior side of the base support 605, and preferably extends substantially across the full length of the base support 605. The slot 609 may be located roughly in the middle of the base slot 605, as shown in cross-sectional view in FIG. 6B, and may also have an internal nook 611 to facilitate gripping by an attachment means such as hooks 614 or other grappling members, which are attached to the bottom of expandable cover 610 (generally corresponding to expandable cover 110 shown in FIGS. 1A-1C and elsewhere in the figures).

The hooks 614 in this example are generally rectangular in shape, with a profile that matches the contours defined by the outer surfaces (top and side) of the base support 605, and by the shape of the slot 609 including nook 611. The hooks 614 may be configured with a crossmember 628 and a curved tip 629 which extends into the nook 611, allowing the hook 614 to securably grip the base support 605 as the expandable cover 610 slides back or forth along the base support 605. The number of hooks 614 may be the same as the number of ribs 612, but need not be the same and more or fewer hooks 614 can be used. As illustrated in FIGS. 6A and 6B, each hook 614 may be attached to the expandable cover 610 by, for example, a button clasp or screw assembly 650 which may connect to a grommet 651 or other similar mechanism attached to the expandable cover 610. The hooks may be rigidly attached, or else they may have some play so that they can pivot relative to the grommet 651 which may facilitate the maneuvering of the expandable cover 610, particularly at the ends of the base support 605.

In operation, as the expandable cover 610 is pulled or otherwise maneuvered forward along the base support 605, the hooks 614 guide the expandable cover 610 along the direction of the base support 605, facilitating rapid deployment of the expandable cover 610 and assuring that the cover mechanism will take on a prescribed shape. The ribs 612 provide upwards structural support for the expandable cover 610, allowing the fabric or material thereof to gradually unfold to form a covered shelter.

Figure 6C:
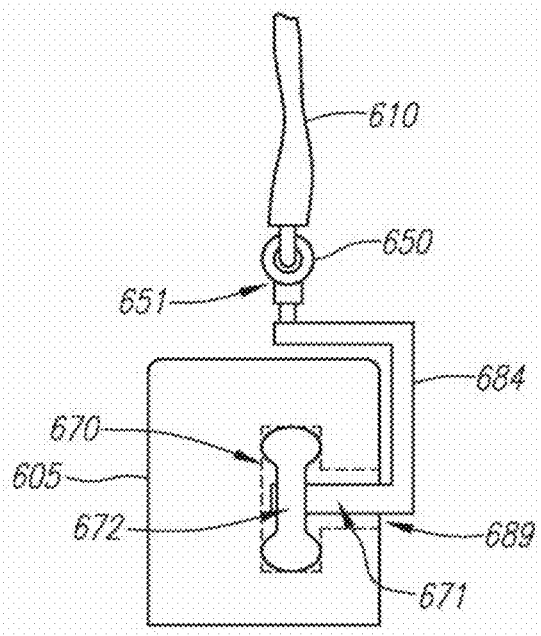
FIG. 6C is a cross-sectional diagram of another embodiment of a sliding extension track associated with a base support for a cover mechanism.

In other embodiments, the hook member may have a wheel, roller, or runner to facilitate the sliding motion of the expandable cover 610 along the track. An example of this type of embodiment is illustrated in FIG. 6C, in which a vertical wheel 672 is attached to the end of the grappling member 684, and which is otherwise similar to FIG. 6A in arrangement and operation. In this case, the crossmember 628 of FIG. 6B becomes an axle 671 for the wheel 672, which is disposed in a T-shaped slot 689 and, specifically, within the internal groove 670 that, in this example, is approximately the same height as the wheel 672. The wheel 672 not only helps secure the expandable cover 610 to the base support 605, but also facilitates more rapid deployment and retraction of the expandable cover 610. Although the wheel 672 is shown in vertical arrangement, it could also be oriented in a horizontal fashion, with the T-shaped slot 689 at the top of base support 605 instead of the side thereof. Other variations are also possible and will be apparent to those skilled in the art.

In one aspect, the base support 605 with slotted groove 609 or 689 and associated hooks, wheels, rollers, or other grappling members, collectively form a sliding extension track for guiding the expandable cover during deployment or when retracting it for stowage. The expandable cover 610 may be deployed manually, or else the sliding extension track may be mechanized, particularly for larger embodiments, using for instance a chain or cable to pull or maneuver the grappling members along the length of the base support 605. In these embodiments, the cover mechanism may be motorized in a manner similar to convertible automobile covers, and the design and construction of suitable motor mechanisms for the above purposes is considered within the purview of one skilled in the art given the teachings of the description herein.

In other embodiments, it may be possible to dispense with the base supports, and simply use wheels that engage with the ground or resting surface.

Figure 8A:
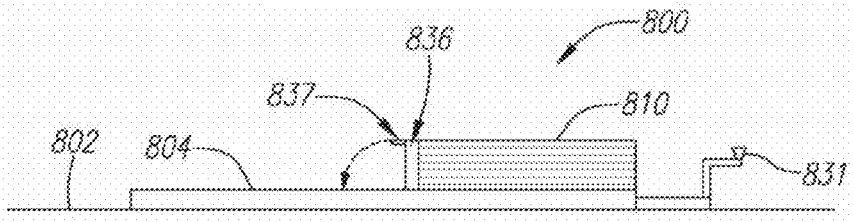
FIGS. 8A-8D are diagrams illustrating yet another embodiment of a cover mechanism, having base supports with a releasably locking rail.

FIGS. 8A through 8D are side view diagrams illustrating yet another embodiment of a cover mechanism 800, having base supports with a releasable locking rail, but otherwise generally similar to the cover mechanism 100 illustrated in FIGS. 5A-5E. As shown in FIG. 8A, the cover mechanism 800 in this embodiment may have a support frame that includes base supports 804 (preferably a pair of parallel base supports similar to FIG. 2B) but extending to the top of the expandable cover 810 when it is in its compact, non-deployed state. The cover mechanism 800 further includes a sliding guide member 836 for each base support 804, and may further include a hand crank 831 for manual operation (which may be replaced by a motor for automated operation). The sliding guide member 836 has a latching member 837, and is preferably hingably attached to the base support 804 so that the guide member 836 and expandable cover 810 may be pivoted together to allow the guide member 836 to eventually come to rest atop the base support, with the latching member 837 securably latching into a locking device. As the guide member 836 is pivoted forward, the expandable cover 810 partially unfolds, with the ribs 812 spreading apart as previously described to allow a portion of the self-supporting structure to be deployed.

Figure 8B:
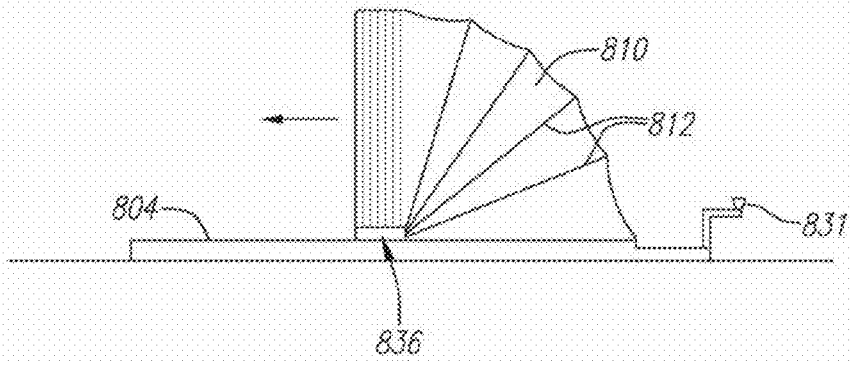
Figure 8C:
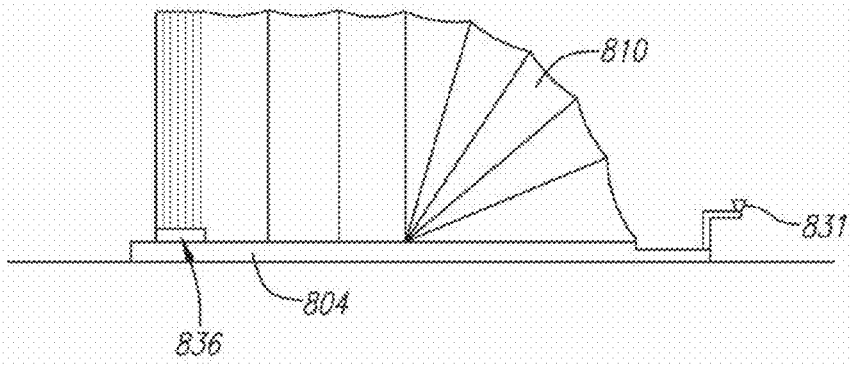

The base supports 804 in this embodiment act as rails, and when the hand crank 831 is turned (or motor operated, in automated embodiments), as illustrated in FIGS. 8B and 8C, the sliding guide member 836 is pulled in a forward direction, allowing the expandable cover 810 to deploy further. When the sliding guide member 836 reaches the front end of the base support, it pivots forward and allows the remainder of the expandable cover 810 to be deployed, forming a complete self-supporting structure similar to the one shown in FIG. 1A.

Figure 8D:
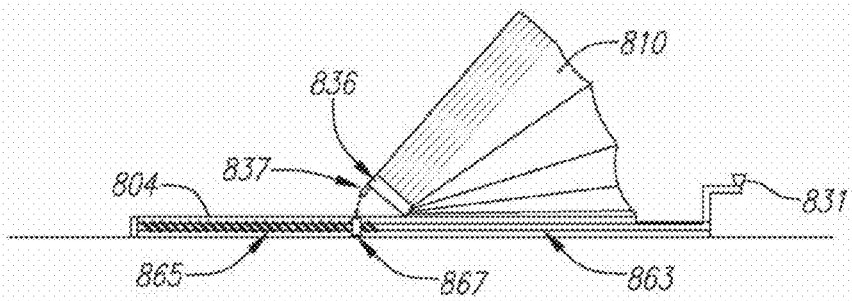

In a preferred embodiment, as illustrated in FIG. 8D, the hand crank 831 (or motor if applicable) moves the sliding guide member 836 by operating a lead screw 865 which translates the rotational motion of the lead screw 835 to linear motion of the sliding guide member 836. When the latching member 837 is pivoted forward, it engages with and locks into a latching device 867 that comprises a nut which can be moved forward and back along the lead screw 865. When the crank 831 is turned (whether manually or by motor), via appropriate gearing a shaft 863 is rotated which in turn rotates the lead screw 865 that extends along at least the portion of the base support 804 from the point at which the sliding guide member 836 engages the latching device 867 to the forward end of the base support 804. In this way the sliding guide member 836 can be maneuvered forward and backward along the base support 804. Of course, a variety of other similar means may be used to move the sliding guide member 836 or an analog thereof along the base support 804. In some embodiments, for example, rollers may be used to facilitate the motion of the sliding guide member along the base supports.

To retract the cover mechanism 800, the expandable cover 810 may be pivoted upwards until the sliding guide member 836 is again flush with the base support 804 at the forward end thereof, and then the hand crank 831 may be used to bring the sliding guide member 836, and hence the expandable cover 810, back towards the direction of the hand crank 831. Once the sliding guide member 836 is at the end of its track, the sliding guide member 836 may be unlatched from the locking mechanism 867 and pivoted back, so that the expandable cover 810 returns to its compact state as illustrated in FIG. 8A.

Figure 4A:
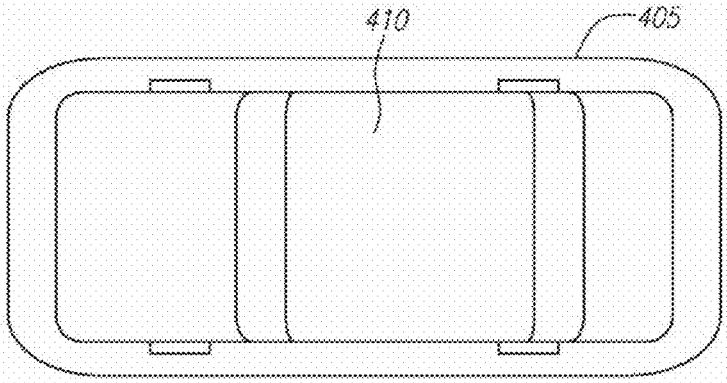
FIGS. 4A-4C are examples of variously sized vehicle covers for different uses or applications.
Figure 4B:
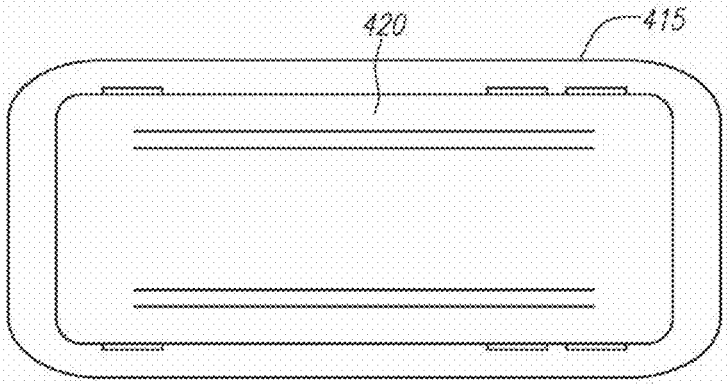
Figure 4C:
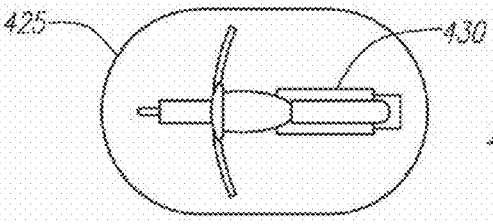

A cover mechanism according to various embodiments as disclosed herein may find a wide variety of uses and applications, and particularly may be well suited for protecting vehicles and other conveyances. FIGS. 4A-4C are top views of cover mechanisms having different shapes and sizes, illustrated at least some potential applications and uses. For example, FIG. 4A shows a cover mechanism 405 that may be generally shaped and deployed according to the teachings of FIGS. 1A-1C, to encompass and shelter an automobile 410. FIG. 4B shows another cover mechanism 415 that is large enough to cover a transit vehicle 420. FIG. 4C shows a cover mechanism 425 that is smaller in size, adequate to encompass and shelter a motorcycle 430. Thus, the cover mechanism may be varied in size and shape to suit the subject which is to be covered and protected thereby.

Figure 7A:
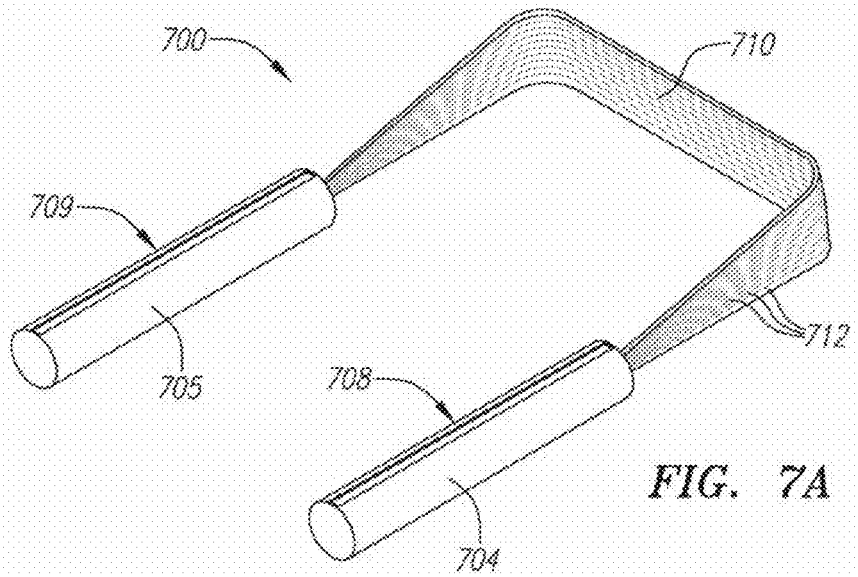
FIGS. 7A and 7B are diagrams illustrating another embodiment of a cover mechanism as disclosed herein, particularly suited for a watercraft.
Figure 7B:
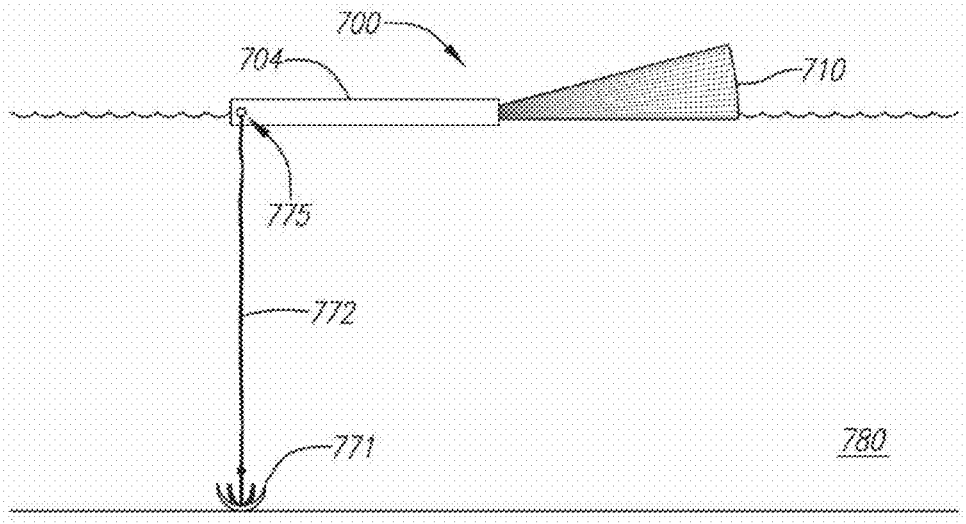

The cover mechanism is not limited to use with ground-based vehicles or conveyances, and may, for example, be used with watercraft. FIGS. 7A and 7B are diagrams illustrating an embodiment of a cover mechanism 700 that is suited for a watercraft. FIG. 7A shows the cover mechanism 700 in a non-deployed or compact state. Rather than having base supports which rest on the ground or similar firm surface, the cover mechanism 700 has floating pontoons 704, 705 which serve an analogous purpose and form the aquatic base supports for the cover mechanism 700. The floating pontoons 704, 705 may be made in whole or substantial part from foam or other inherently buoyant material, or else may be inflatable or have an inflatable portion which keeps the cover mechanism 700 afloat. The cover mechanism 700 further comprises an expandable cover 710 of similar structure and operation to expandable cover 110 described with respect to FIGS. 1A-1C. Thus, the expandable cover 710 may be deployed by unfurling in a forward motion, with the legs of the cover 710 being guided along slots or grooves 708, 709 in floating pontoons 704 and 705, respectively, similar to the mechanism earlier described in relation to FIGS. 5A-5E. As before, hook members, wheels, or other grappling members may be used to secure the expandable cover 700 to the floating pontoons 704, 705 via the slots or grooves 708, 709, and to guide the expandable cover 710 as it is gradually unfurled.

The cover mechanism 700 may have a tripartite structure similar to FIGS. 1A-1C, whereby the watercraft becomes completely enclosed beneath the expandable cover 710. Alternatively, the expandable cover 710 may be of a size such that it deploys only to the edge of floating pontoons 704, 705, so that it covers the watercraft from the top but does not fully enclose the watercraft, leaving a front opening for easy entry and exit of the watercraft.

The cover mechanism 700 may be secured to a wharf or dock by ropes, lines or otherwise, and may have perforations or vents for ropes or lines to allow the watercraft to be independently secured to a mooring. Alternatively, or in addition, the aquatic cover mechanism 700 may be outfitted with an anchor 771 (one or more), which can be secured to a deadeye 775 or other fastener on the floating pontoon 704 (and/or 705) by means of a line 772 such as a rope, cable or other means. In particular, two anchors 771 attached to the forward ends of the floating pontoons 704, 705 may be used to provide greater stability for the cover mechanism 700 and help maintain its orientation. The two floating pontoons 704, 705 may also be joined or linked together by a cable, rope or other interconnection beneath the surface of the water, suitably weighted so that it lies at a sufficient depth to avoid interference with the watercraft's hull, rudder and/or propeller blades, as the case may be.

In various embodiments, a versatile cover mechanism is provided which may have many uses and applications, and which may be particularly well suited to covering and protecting vehicles, watercraft, or other conveyances. The cover mechanism may be rapidly deployable and, likewise, readily folded and made compact for storage. The cover mechanism may be configured in a variety of different shapes or sizes depending on the particular application and use, or particular preferences. By choice of fabric and materials, it may be generally durable and weather resistant. Although the cover mechanism may be lightweight and easily transportable, it nonetheless can provide a rigid and self-supporting structure adequate for protecting an item, such as an automobile or vehicle, from the elements or other outside influences. The cover may rest on the ground or other firm surface, or else, at least in certain embodiments, on any other stable medium, such as a body of water.

While preferred embodiments of the invention have been described herein, many variations are possible which remain within the concept and scope of the invention. Such variations would become clear to one of ordinary skill in the art after inspection of the specification and the drawings. The invention therefore is not to be restricted except within the spirit and scope of any appended claims.

What is claimed is:

1. A cover mechanism, comprising:

a support frame comprising a pair of parallel base supports; and an expandable cover engaged with said parallel base supports and having a pliable exterior cover and a plurality of ribs integral therewith, the expandable cover being foldable when not deployed and being expandable to form a self-supporting structure when deployed;

wherein the expandable cover is attached to the parallel base supports by a plurality of hooks, each hook comprising a length of material whose length is curved into an L-shape having a horizontal segment and a vertical segment, the L-shape extending into a matching L-shaped groove of a corresponding one of the parallel base supports, the matching L-shaped groove including a horizontal groove portion and a vertical groove portion.

2. The cover mechanism of claim 1, wherein the base supports each have a groove for guiding the expandable cover, and wherein the hooks slide along the length of the grooves to guide the deployment of the expandable cover.

3. The cover mechanism of claim 1, wherein each of the plurality of hooks has a profile shape matching the contours defined by top and side surfaces of each of the parallel base supports.

4. The cover mechanism of claim 1, wherein the plurality of hooks is greater in number than the plurality of ribs.

5. The cover mechanism of claim 1, wherein the pliable exterior cover comprises a plurality of grommets, and further comprising:

a plurality of connectors attaching each of the plurality of hooks to a corresponding one of the plurality of grommets.

6. The cover mechanism of claim 5, wherein each of the plurality of connectors comprises a button clasp.

7. The cover mechanism of claim 5, wherein each of the plurality of connectors comprises a screw assembly.

8. The cover mechanism of claim 1, wherein the support frame is adapted to rest on a stable medium.

9. The cover mechanism of claim 1, wherein the support frame further comprises a plurality of floating pontoons.

10. The cover mechanism of claim 9, wherein each of the plurality of floating pontoons comprises at least one inflatable portion.

11. The cover mechanism of claim 1, wherein each hook comprises a rectangular profile matching contours defined by top and side outer surfaces of the corresponding one of the parallel base supports.

* * * * *